US006398335B1

(12) United States Patent
Benjamin

(10) Patent No.: US 6,398,335 B1
(45) Date of Patent: Jun. 4, 2002

(54) MAGNETIC CONNECTION OF INK-JET PRINTER COMPONENTS

(75) Inventor: Trudy L. Benjamin, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/540,701

(22) Filed: Mar. 31, 2000

(51) Int. Cl.[7] ..... B41J 1/00

(52) U.S. Cl. ..... 347/19; 347/49; 347/86; 400/175; 399/12

(58) Field of Search ..... 347/14, 19, 49, 347/86, 87; 399/12, 106; 400/175; 324/205, 207.11, 207.13; 340/547; 403/DIG. 1

(56) References Cited

U.S. PATENT DOCUMENTS

| | | | | |
|---|---|---|---|---|
| 1,236,234 A | * | 8/1917 | Troje | 446/92 |
| 4,682,188 A | | 7/1987 | Castellano | 347/8 |
| 4,853,708 A | * | 8/1989 | Walters | 347/86 |
| 4,950,987 A | * | 8/1990 | Vranish et al. | 324/207.23 |
| 4,963,939 A | | 10/1990 | Kurandu et al. | |
| 5,040,002 A | | 8/1991 | Pollacek et al. | 347/87 |
| 5,063,372 A | * | 11/1991 | Gillett | 340/547 |
| 5,168,291 A | * | 12/1992 | Hiramatsu et al. | 347/19 |
| 5,289,242 A | * | 2/1994 | Christensen et al. | 399/12 |
| 5,506,611 A | * | 4/1996 | Ujita et al. | 347/86 |
| 5,583,545 A | | 12/1996 | Pawlowski et al. | 347/7 |
| 5,734,401 A | | 3/1998 | Clark et al. | 347/86 |
| 5,751,322 A | | 5/1998 | Miller et al. | 347/86 |
| 5,877,795 A | * | 3/1999 | Gragg et al. | 347/92 |
| 6,015,209 A | | 1/2000 | Barinaga et al. | 347/86 |
| 6,030,229 A | * | 2/2000 | Tsutsui | 439/39 |

FOREIGN PATENT DOCUMENTS

| | | | | |
|---|---|---|---|---|
| GB | 2 346 221 | | 8/2000 | |
| JP | 60204332 | | 10/1985 | |
| JP | 60224551 | | 11/1985 | |
| JP | 61156165 | | 7/1986 | |
| JP | 040338989 | | 11/1992 | |
| JP | 110198397 | | 7/1999 | |
| JP | 11218379 | * | 8/1999 | ..... F25D/23/02 |
| JP | 110254716 | | 9/1999 | |

OTHER PUBLICATIONS

UK Patent Office Search Report re App No. GB 0106621.6 May 16, 2001, 1 page.

* cited by examiner

*Primary Examiner*—John Barlow
*Assistant Examiner*—Blaise Mouttet

(57) ABSTRACT

A component, such as an ink cartridge, is provided with magnetic members. A corresponding component in the printer system, such as a carriage, is also provided with magnetic members so that magnetic attraction between the two components provides or enhances the connecting force between those components. The magnetic members on one component (such as the ink cartridge) are arranged in a particular pattern that indicates a print characteristic of the cartridge. The print characteristic may relate to the color of the ink in the cartridge that is used. A corresponding pattern is provided in the carriage. The pattern is such that magnetic force will attract the cartridge when positioned in the correct mating location in the carriage. This magnetic attraction is provided as tactile feedback to the user in the course of seating the cartridge in the correct location. The mating locations of the carriage are provided with various patterns of magnetic member arranged to provide a magnetic repulsion when one attempts to place a cartridge into the incorrect location on the carriage.

17 Claims, 2 Drawing Sheets

MAGNETIC CONNECTION OF INK-JET PRINTER COMPONENTS

TECHNICAL FIELD

This invention relates to methods and apparatus for accurate connection of ink-jet printer components, such as ink cartridges, to other ink-jet printer components, such as carriages.

BACKGROUND AND SUMMARY OF THE INVENTION

An ink-jet printer produces images and text on a page by firing drops of ink from the printheads of one or more ink cartridges while the cartridges move back and forth across the page. Examples of ink-jet printers include plotters, facsimile machines, and typical computer-attached ink-jet printers. The page on which a printer prints may be any sheet material, such as paper, mylar, foils, transparencies, card stock, etc.

The ink supply of an ink-jet printer is limited. Thus, many cartridges are designed to be replaceable. A user simply replaces the old, empty ink cartridge with a new, full ink cartridge. In these so-called cartridge-type printers, the cartridges are manufactured as a unit that includes a printhead and an ink reservoir. Thus, the cartridges are seated in a carriage that travels back and forth across the page during the printing operation.

In some designs, the ink reservoir is a container that may be disconnected from the printhead, which remains installed on the carriage while the container is replaced.

In so-called off-axis printers, only a printhead moves across the page. Ink is delivered to an inlet port in the printhead via a flexible, ink delivery tube that extends from a stationary ink reservoir. Typically, the ink reservoir is mounted to the printer chassis and may be replaced or refilled when empty. Off-axis printers may be equipped either with a single printhead for monochromatic printing, or with several printheads for color printing. Of course, for color printing, several reservoirs and associated tubes are required, with one set used for each color.

In the ink-delivery systems of off-axis printers, the ink-delivery tube may be permanently connected to the printhead, but this would prevent replacement of the printhead. The printhead may suffer mechanical breakdown or simply wear-out after firing millions of drops of ink. Therefore, the printheads of a typical ink-jet printer are designed to be replaced, as necessary. To this end, the ink-delivery tube may terminate in a needle for piercing a resilient septum that is carried on the printhead and that otherwise seals the inlet port of the printhead. A needle/septum interface mechanism such as this allows for disconnection of the tube and printhead for occasional replacement of the printhead. A similar interface may be employed where the ink-delivery tube joins the stationary ink reservoir.

The supply of ink in reservoirs or containers used in cartridge-type or off-axis type printers may be replenished in refill stations that are peripheral components of the printer system.

Irrespective of the nature of the removable ink-jet printer component (ink cartridge, reservoir or printhead, for example), it is desirable to ensure that those components are accurately connected in the printer. That is, a component such as an ink cartridge must be properly seated in the carriage. Also, in instances where a carriage is designed to carry more than one cartridge, it is important that the ink container having the correct print characteristic (such as ink color) be located in the correct position in the carriage, so that the printer controller can precisely control the printing of drops of that color.

This proper seating and positioning requirement also applies to off-axis printers, especially where several reservoirs and associated ink-delivery tubes are involved.

In the past, various mechanical latches, datum features, and/or electrical identification techniques have been employed for ensuring that a replaceable ink-jet printer component is properly connected in the correct location.

The present invention may be used in lieu of, or in conjunction with, the prior approaches and primarily features the use of magnetic force to enhance the strength and accuracy with which replaceable components are connected in a printer.

As one aspect of the present invention, a component such as an ink cartridge is provided with magnetic members. A corresponding component is also provided with magnetic members so that magnetic attraction between the two components provides or enhances the connecting or clamping force between those components.

As another aspect of the present invention, the magnetic members on one component (such as the ink cartridge) are arranged in a particular pattern that indicates a print characteristic of the cartridge. The print characteristic may relate to the color of the ink in the cartridge, or to other characteristics, such as the reservoir size of the cartridge that is used. A corresponding pattern is provided in the carriage. The pattern is such that magnetic force will attract a particular cartridge to the correct mating location in the carriage. This magnetic attraction is provided as tactile feedback to the user in the course of seating the cartridge in the correct location in the cartridge. The other mating locations in the carriage (that is, locations intended for cartridges having other print characteristics, such as other colors) do not have patterns corresponding to that particular cartridge and thus do not provide magnetic attraction when one attempts to connect that cartridge in one of the other mating locations. This lack of attraction is also felt by the user as tactile feedback that alerts the user to the attempted, improper placement of the cartridge.

In one preferred embodiment of the invention the mating locations of the carriage are provided with various patterns of magnetic member arranged to provide a magnetic repulsion (easily sensed by the user) when one attempts to connect one component at an incorrect location in the printer.

In yet another embodiment, the proximity of a magnetic member on one component is detected by a sensor on the other component. The sensor output is provided to the printer controller for conversion into, for example, an audible signal to the user for confirming that the components are properly aligned and/or connected.

Other advantages and features of the present invention will become clear upon review of the following portions of this specification and the drawings.

DETAILED DESCRIPTION OF PREFERRED EMBODIMENTS

Figure 1:
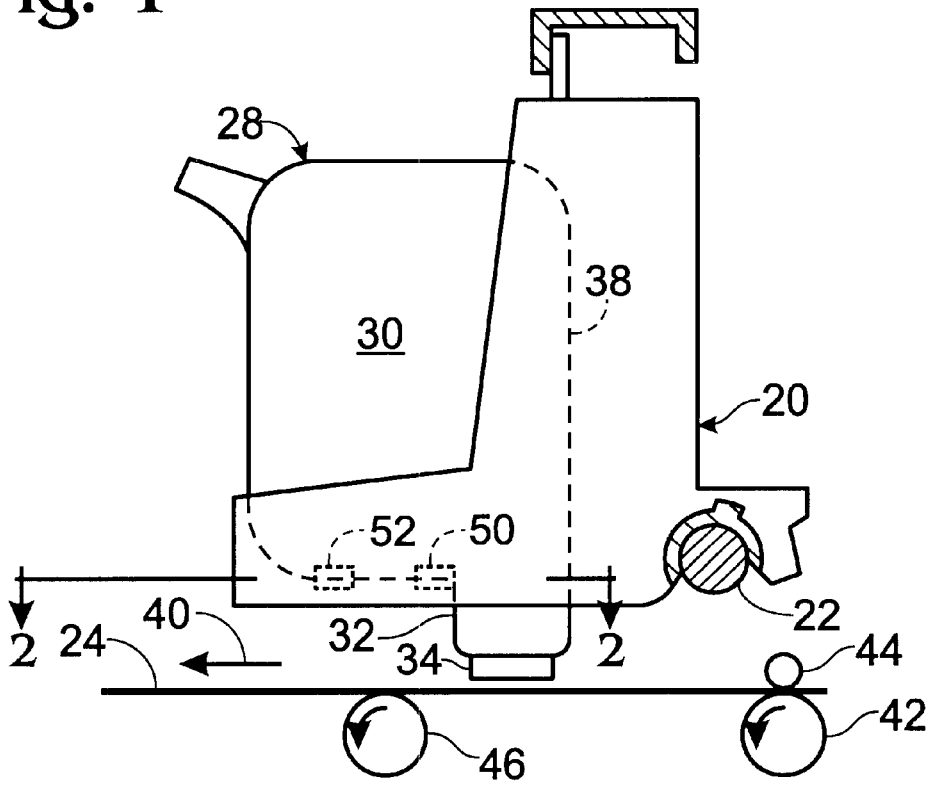
FIG. 1 is a diagram showing in side view ink-jet printer components for which one embodiment of the present invention may be adapted.

With reference to FIG. 1, a preferred embodiment of the present invention is usable with an otherwise conventional ink-jet printer system that includes a carriage 20 that is slidable along a support rod 22 that is housed within the printer. The rod 22 extends across the printer, oriented perpendicular to the direction that paper 24 (or any other printing medium) is advanced through the printer.

One or more ink-jet cartridges 28 are removably connected to the carriage 20. In the illustrated embodiment, four cartridges 28 are contemplated, as may be used with a printer that is adapted for color printing and thus carries cartridges of black, cyan, yellow, and magenta inks for this purpose.

The cartridges 28 include plastic bodies 30 that comprise liquid ink reservoirs shaped to have a downwardly depending snout 32. A printhead 34 (the size of which is greatly enlarged in the drawing) is attached to the end of the snout. The printhead 34 is formed with minute nozzles from which are ejected ink droplets onto the paper 24.

Each cartridge 28 has a circuit mounted on a wall 38 of the cartridge body 30. The circuit includes exposed contacts that mate with contacts of a circuit carried inside the carriage 20. The carriage is connected, as by a flexible, ribbon-type multi-conductor, to the printer microprocessor, which provides to the cartridges control signals for precisely timed ejection of ink droplets. The droplets render text or images on the advancing paper as the carriage is reciprocated across the printer (i.e., into and out of the plane of FIG. 1).

FIG. 1 also illustrates in somewhat simplified fashion a portion of the path of the paper 24 through the printer. Each cartridge 28 is supported above the paper 24 by the carriage 20 such that printhead 34 is maintained at a desired spacing. The paper 24 is picked from an input tray and driven into the paper path in the direction of arrow 40. The leading edge of the paper is fed into the nip between a drive roller 42 and an idler or pinch roller 44 and is driven into the zone underlying the printhead 34, from where it encounters an output roller 46 that advances the paper into an output tray.

As noted above, the print cartridges 28 are removable from the carriage for replacement. A printer system user can easily remove and replace cartridges. This embodiment contemplates that the mechanical latches, datum features, and/or electrical identification techniques, which have been employed in the past for ensuring that a replaced cartridge is properly connected to the printer, are included in the components shown in FIG. 1. For the purposes of this description, however, these elements are not illustrated.

This description now turns to the particulars of the present invention for properly connecting printer components such as an ink cartridge 28 to another component, such as the carriage 20 in a manner that employs magnetic force. As noted, in this embodiment, this magnetic force is intended to augment other techniques for securing the cartridge in place. It is understood, however, that the magnetic-connection approach of the present invention may be used alone for both securing the cartridge to the carriage and ensuring that the cartridge is located on the proper location in the carriage.

It is noteworthy here that the term "magnetic member" as used in this description is intended in a generic sense to include elements having naturally occurring or induced magnetic fields, as well as substances (sometimes called ferromagnetic) comprised of iron, nickel, or cobalt and various alloys that are attracted to a magnet. The context of this description makes clear the specifics of the magnetic members in particular preferred embodiments.

With reference to FIG. 1, the body 30 of each cartridge carries magnetic members 50, 52 in the form of permanent magnets that define magnetic fields having characteristic polarity. In this embodiment, there are a total of four magnetic members attached to the cartridge, although only two 50, 52 appear in FIG. 1. In this regard, reference is made to FIG. 2, which illustrates the base 70 of the carriage to which the cartridges 28 are connected. That base 70 includes four mating locations or bays 72, 74, 76, 78. One cartridge mates or connects with one bay. Moreover, each bay 72, 74, 76, 78 is intended to receive a cartridge of a particular print characteristic, such as color.

Thus, for example, bay 72 receives a cartridge with a reservoir of black-colored ink. Bay 74 receives a cartridge with a reservoir of magenta-colored ink. Bay 76 receives a cartridge with a reservoir of yellow-colored ink, and bay 78 receives a cartridge with a reservoir of cyan-colored ink. The print controller of the printer controls the printing of a colored image with particular control signals directed to the cartridges arranged in the bays as just described.

Each bay includes a pattern of four magnetic members. Bay 72, for instance, includes magnetic members 150, 152, 154, 156, arranged in pairs as shown. That bay 72 is intended to receive the cartridge that appears in FIG. 1. The four magnetic members on the associated cartridge 28 are patterned in a manner such that they will align with the corresponding magnetic members 150, 152, 154, 156 in the base 70 of the carriage. Inasmuch as the magnetic members on the cartridge are magnets, the magnetic members in the base 70 may be ferromagnetic material, so that there will be provided a magnetic attraction force between the cartridge and the carriage as the cartridge is brought into engagement with the bay 72. This arrangement could be reversed; the magnets in the bay and the ferromagnetic material on the cartridge.

In one preferred embodiment, the magnetic members 150, 152, 154, 156 that are carried in the base of the carriage are also magnets, and these are arranged so that the polarity of the associated magnetic field is in a pattern that complements that of the four magnets of the cartridge. For example, magnet 150 is arranged with its north pole "N" exposed to face an exposed south pole in the corresponding cartridge magnet 50. This results in development of a strong attractive force between the cartridge and carriage in the vicinity of these two magnets 50, 150.

Similarly, the carriage magnet 152 is arranged with its north pole "N" exposed to face an exposed south pole in the corresponding cartridge magnet 52. The other two magnets 154, 156 in the bay 72 are arranged with their south poles "S" exposed to face exposed north poles in the corresponding cartridge magnets (not shown) when the cartridge is connected to the bay 72.

It will be appreciated that the resultant magnetic attraction between the cartridge and carriage bay will provide the user with tactile feedback that assures the user that the cartridge is properly seated.

It will be appreciated that any of a number of ways can be used to attach the magnetic members to the associated components. For example, the magnets 50, 52 on the cartridge 28 may be bonded into correspondingly shaped recesses in the cartridge body 30. Alternatively, the magnets could be integrated with an injection molding operation that forms the body 30 of the cartridge. The magnetic member may be flush with, slightly raised from, or recessed in the outer surface of the material (plastic) that makes up the cartridge body. Also, any of these alternatives may be used for attaching the magnetic members in the bays of the carriage 20.

Figure 2:
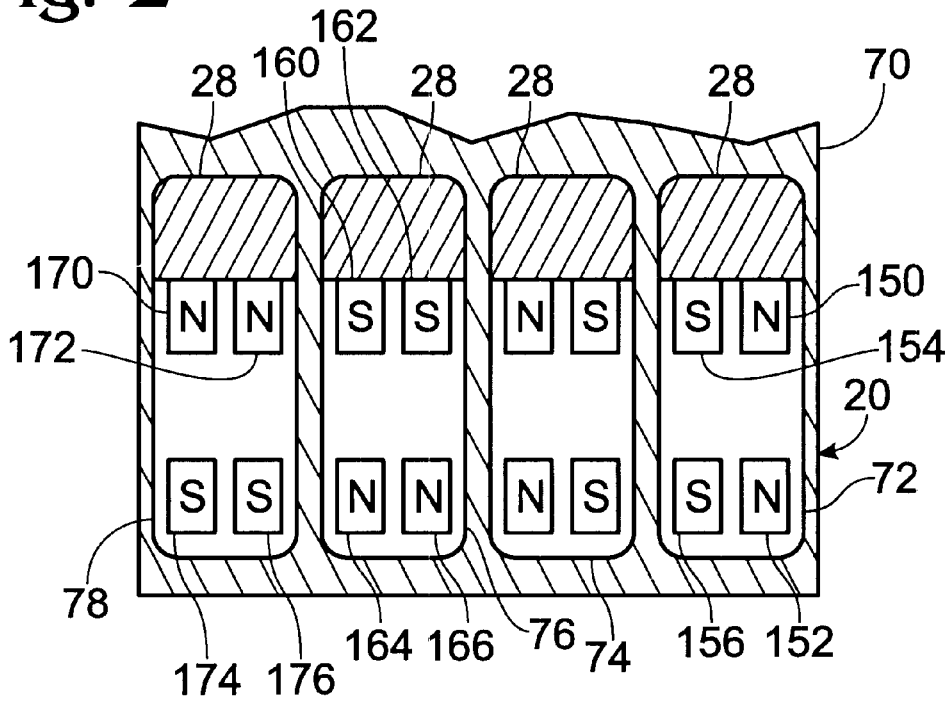
FIG. 2 is a cross section taken along line 2—2 of FIG. 1.

As shown in FIG. 2, each of the bays 72, 74, 76, 78 has a unique arrangement of magnetic poles corresponding to the four magnets of each bay. For instance, in bay 76 (which bay is configured to receive, for example, a yellowink cartridge), the magnetic members are arranged so that the forward pair 160, 162 (that is, the pair nearest the printhead 34) is oriented with their south "S" poles exposed. The rearward pair 164, 166 is oriented with their north "N" poles exposed. A yellow-ink cartridge will have a magnet pattern that complements the pattern in bay 76, such that the forward pair of magnets expose the "N" poles and the rearward pair expose the "S" poles.

The magnets in bay 78, which is intended to receive a cyan-ink cartridge, are arranged in a pattern that is the reverse (as respects polarity) of the pattern in bay 76. In the cyan-cartridge bay 78, the magnetic members are arranged so that the forward pair 170, 172 is oriented with their north "N" poles exposed. The rearward pair 174, 176 is oriented with their south "S" poles exposed. A cyan-ink cartridge will have a magnet pattern that complements the pattern in bay 78, such that the forward pair of magnets exposes "S" poles and the rearward pair exposes "N" poles.

In view of the foregoing, it will be appreciated that the pattern of magnets on a cartridge corresponds to a print characteristic (here, color) associated with that cartridge. Thus, the distinct patterns provide an encoding or keying feature that aids the user in ensuring that the correct color cartridge is connected to the correct bay.

For instance, it is apparent that if one were to attempt to connect a cyancolor cartridge (forward poles being "S" and rearward poles being "N") to the yellow bay 76, the resultant like-pole alignment of the cartridge and bay magnets would produce a strong magnetic repelling force that would be instantly felt by the user to apprise the user of the attempt to improperly connect the two components.

The distinctive magnetic-member patterns may be configured in something other than the polarity arrangements discussed above. For instance, the cyan, yellow, magenta, and black cartridges could all have the same magnet polarities exposed, but the magnets themselves would be spaced in an arrangement that is unique to its given color, and complementary to the same pattern on the corresponding bay. For example, a cyan cartridge could be made with only two magnets in the forward part of the body, and the yellow cartridge could be made with only two magnets located in the rearward end of the body. In this instance, the attempt to connect a cyan cartridge to a yellow bay would result in no alignment of complementary magnets; hence the user would feel no magnetic attraction force.

Patterns of fewer or more than four magnetic members are contemplated. A single magnet could be used with one or both poles exposed. If one pole were exposed, the spatial variation of the magnets vis-à-vis those of the other cartridges would enable the encoding feature discussed above.

Figure 3:
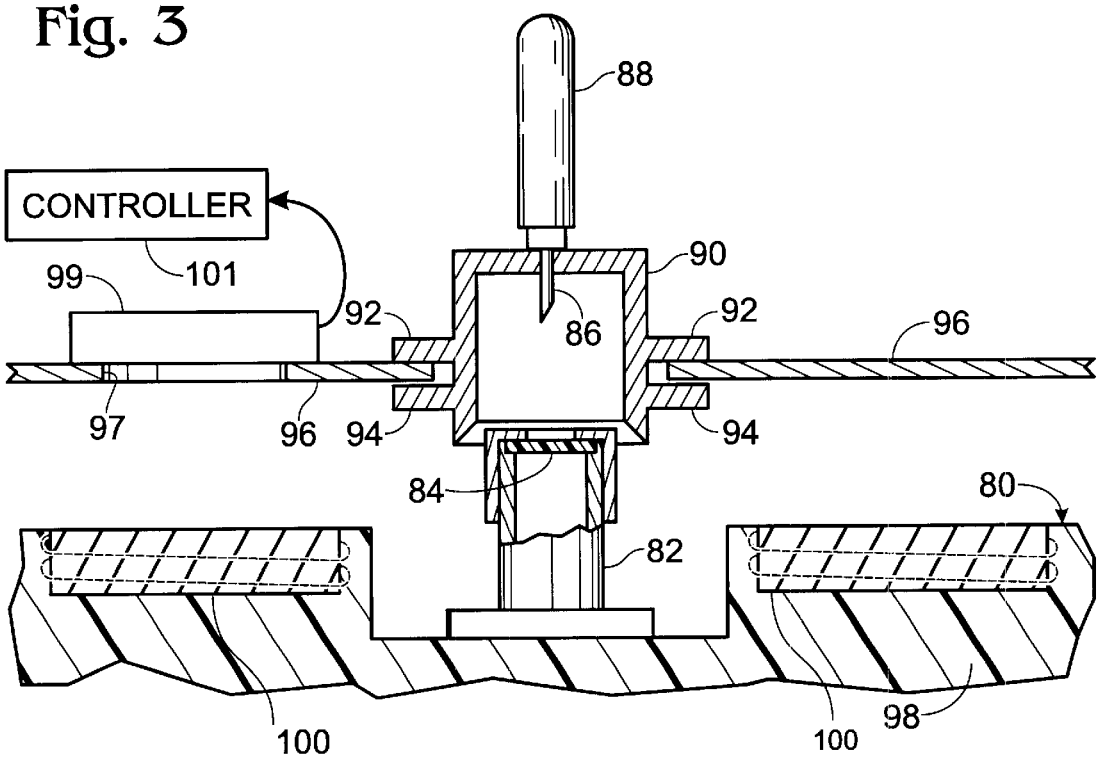
FIG. 3 is a diagram showing in side view an alternative embodiment of the present invention illustrating the position of two ink-jet components prior to connection.
Figure 4:
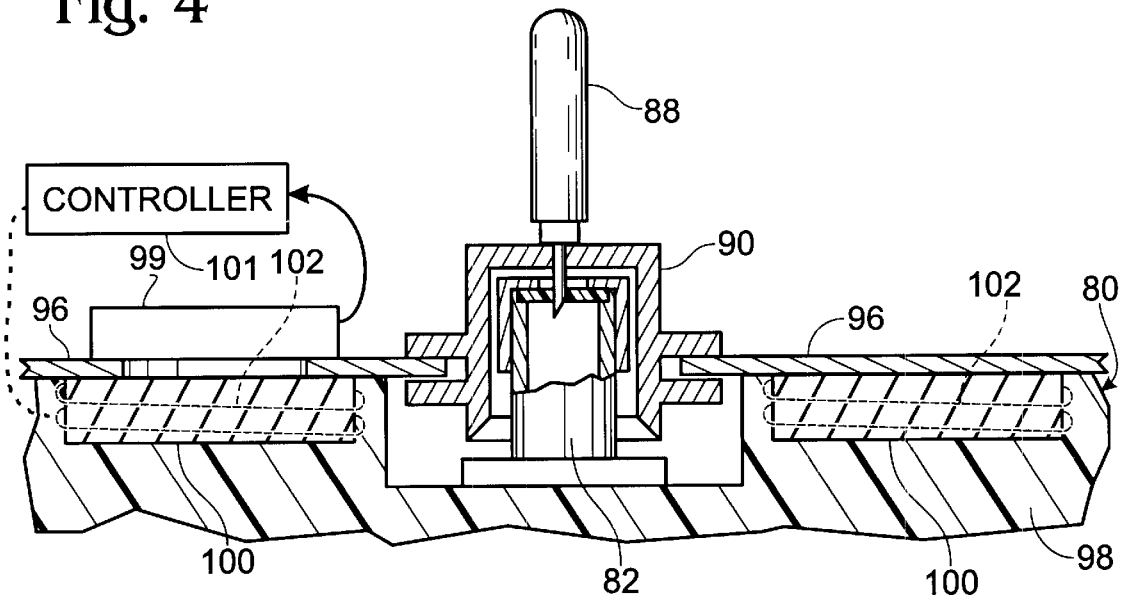
FIG. 4 is a diagram like FIG. 3 but showing the position of the two ink-jet components after connection.

FIGS. 3 and 4 depict another embodiment of the present invention wherein magnetic force is provided for securing together a sealed needle/septum interface mechanism as may be used with an ink-delivery system of an off-axis printer. One such interface, to which the present invention may be adapted, is described in U.S. Pat. No. 5,751,322. The needle and septum components are occasionally disconnected for replacing the printhead.

With reference to FIG. 3, the off-axis printer includes a printhead 80 having a tubular inlet port 82 into which ink is directed to supply the printhead. Only an upper portion of the printhead is shown in FIGS. 3 and 4 since the drawings are greatly enlarged. The ink inlet port 82 is sealed by an elastomeric septum 84 made from a silicone elastomer or an EDPM elastomer.

The septum 84 is pierced by a sharp needle 86 that is carried at the terminus a flexible ink-delivery tube 88 that is connected at its other end to a stationary ink reservoir. The needle is mounted to project inside of a hollow cylinder 90. In FIG. 3, the cylinder 90 is shown in a position just before it is moved downwardly over the inlet 82 in the course of connecting those two components in a manner such that the needle 86 pierces the septum 84.

The cylinder 90 has spaced-apart flanges 92, 94 between which fit the inner edges of an opening in a connector plate 96. The fit is somewhat loose, to enable slight relative movement of the cylinder 90 relative to the plate 96 to ensure proper alignment of the needle and septum. The plate is hingedly attached to the printer, to be lifted and lowered by the used in respectively disconnecting and connecting the needle and septum interface. In this embodiment, the connector plate 96 is formed of ferromagnetic material.

FIG. 4 shows the connected position of the needle and septum interface. In accord with the present embodiment, the printhead body 98 includes one or more magnets 100 recessed or embedded therein. The magnets 100 are located so that when the needle and septum are connected the magnetic force of the magnets 100 pull the connector plate 96 against the magnet (hence, against the body 98 of the printhead) to enhance the connection between the needle and the septum seal. The present invention may be applied to other valving or connection techniques.

Although only the clamping effect of the provided magnet members 96, 100 was discussed above in connection with this embodiment (FIGS. 3 and 4), it will be understood that, where multiples of such interfaces are employed (as with color printing) the magnetic members can be arranged in patterns to obtain the encoding or keying advantages discussed above in connection with the other (FIGS. 1 and 2) embodiments.

The advantages of the present invention may be further enhanced by the use of a proximity sensor, the particulars of which are discussed next in connection with the embodiment of FIGS. 3 and 4, but with the understanding that the sensing technique is applicable to many different embodiments of the invention, including that described above in connection with FIGS. 1 and 2.

As shown in FIGS. 3 and 4, the connector plate 96 carries a proximity sensor 99. A preferred sensor 99 is suitable for detecting changes in magnetic flux as the two components (connector plate 96 and printhead body 98) are brought together for connection. An aperture 97 may be provided in the plate 96 to expose the sensing face of the sensor 99.

The output of the sensor 99 is indicative of the proximity of the magnetic member 100 carried on the printhead and is provided to the printer controller 101. The output from the sensor 99 may be converted by the controller 101 to any of a number of signals made available to the user, or used for initiating an automatic action by the controller. For instance, the controller may provide an audible signal to the user for confirming that the components are properly aligned and/or connected.

The magnetic members 100 may be electromagnets (as indicated by the wires 102 shown in dashed lines encircling the magnetic member 100), so that the application of the magnetic force may be toggled on (for connecting the components) or off (for disconnecting the components) by the printer controller. In this regard, the controller 101 provides signals for controlling the strength of the electromagnetic force. Upon detection of the presence of a properly aligned connector plate 96 (or, for example, cartridge 28), which detection is provided by the output of the sensor 99 as discussed above, the controller 101 may provides signals suitable for increasing the strength of the electromagnetic force. The increased pull of the electromagnet has the effect of ensuring a secure connection and providing unambiguous tactile feedback to the user making the connection.

Thus, while the present invention has been described in terms of preferred embodiments, it will be appreciated by one of ordinary skill that the spirit and scope of the invention is not limited to those embodiments, but extend to the various modifications and equivalents as defined in the appended claims.

What is claimed is:

1. An ink-jet printer system having disconnectable components, comprising:

a first component that carries ink and has a magnetic member thereon;

a second component connectable to the first component and having a magnetic member thereon, the magnetic members being arranged to provide magnetic attraction between the first and second components when those components are connected; and a sensor for sensing magnetic attraction between the first and second component before those components are connected.

2. The system of claim 1 wherein the first component is an ink container and the second component includes a carriage that is configured for carrying the ink container that is connected to the carriage.

3. The system of claim 1 wherein the sensor senses magnetic flux.

4. The system of claim 1 wherein the sensor includes an output signal that varies in relation to the proximity of the first component relative to the second component.

5. The system of claim 4 wherein the magnetic member on the second component is an electromagnet for providing magnetic attraction between the first and second components.

6. The system of claim 5 including a controller to which the sensor and the electromagnet are connected, the controller being operable for providing to the user a control signal in response to output signal of the sensor.

7. The system of claim 6 wherein the control signal is for varying the strength of the magnetic attraction provided by the electromagnet.

8. An ink-jet printer system having disconnectable components, comprising:

a first component having a magnetic member thereon;

a second component connectable to the first component and having a magnetic member thereon, the magnetic members being arranged to provide magnetic attraction between the first and second components when those components are connected;

a sensor for sensing magnetic attraction between the first and second component before those components are connected; and wherein the first component is a first connector that includes a conduit attached thereto for conducting ink from one location to another.

9. The system of claim 8 wherein the second component is a second connector that mates with the first connector and that has attached to it a supply of ink.

10. An ink-jet printer system having disconnectable components, comprising:

a first component having a magnetic member thereon;

a second component connectable to the first component and having a magnetic member thereon, the magnetic members being arranged to provide magnetic attraction between the first and second components when those components are connected;

a sensor for sensing magnetic attraction between the first and second component before those components are connected; and wherein the first component is one of a group of components, each component having at least one print characteristic that distinguishes it from the other components in the group and wherein the magnetic member on the first component is arranged to correspond to the print characteristic of the first component.

11. A method for connecting first and second components of a printer system to enable later disconnection of the components for service or replacement, the method comprising the steps of:

providing a magnetic member on the first component and arranging the magnetic member in a predetermined manner that corresponds to a print characteristic of the first component;

defining on the second component a first mating location in a manner such that the magnetic member on the first component is attracted to the first mating location of the second component;

defining on the second component a second mating location in a manner such that the magnetic member on the first component is repelled from the second mating location on the second component; and sensing variations in the proximity of the first and second components as those components are brought toward one another for connection.

12. The method of claim 11 including the step of clamping the first component into the first mating location using electromagnetic force.

13. The method of claim 11 wherein the first and second components are configured so that the first component is moved toward the second component in a first direction in connecting those two components together and wherein the repelling is provided by a magnetic force that is directed to be substantially opposite to the first direction.

14. The method of claim 11 further comprising the step of clamping the first and second components together using a clamping magnetic force.

15. The method of claim 11 including the step of changing the amount of clamping magnetic force in response to the sensed variations.

16. The method of claim 11 further comprising the step of clamping the first and second components together by applying electromagnetic force.

17. The method of claim 16 including the step of releasing the electromagnetic force, thereby to facilitate disconnection of the first and second components.

* * * * *